US008814287B2

(12) United States Patent
Jang

(10) Patent No.: US 8,814,287 B2
(45) Date of Patent: Aug. 26, 2014

(54) REFRIGERATOR

(75) Inventor: Myoung Jin Jang, Gwangsan-gu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/551,673

(22) Filed: Jul. 18, 2012

(65) Prior Publication Data

US 2013/0020922 A1 Jan. 24, 2013

(30) Foreign Application Priority Data

Jul. 22, 2011 (KR) ..... 10-2011-0073250

(51) Int. Cl.
*A47B 96/04* (2006.01)

(52) U.S. Cl.
USPC ..... 312/408; 312/298; 312/313; 312/322; 108/6; 108/17

(58) Field of Classification Search
USPC ..... 312/401, 408, 405.1, 298, 308, 313, 312/322; 108/3, 5, 6, 17, 65, 92, 93
See application file for complete search history.

(56) References Cited

U.S. PATENT DOCUMENTS 2,465,806 A * 3/1949 Jewell ..... 211/153
3,859,932 A * 1/1975 Armstrong et al. ..... 108/75
3,984,163 A * 10/1976 Boorman et al. ..... 312/408
4,620,489 A * 11/1986 Albano ..... 108/105
2003/0020387 A1* 1/2003 Wing et al. ..... 312/408
2007/0176528 A1* 8/2007 Lee et al. ..... 312/408
2008/0303401 A1* 12/2008 Ji ..... 312/405.1
2009/0250420 A1* 10/2009 Martin et al. ..... 211/134
2010/0109498 A1* 5/2010 Ramm et al. ..... 312/408
2010/0253197 A1* 10/2010 Jung ..... 312/408
2011/0001415 A1* 1/2011 Park et al. ..... 312/408

FOREIGN PATENT DOCUMENTS

JP 2002-267350 9/2002
KR 10-2005-0102819 10/2005

* cited by examiner

*Primary Examiner* — Daniel Rohrhoff
(74) *Attorney, Agent, or Firm* — Staas & Halsey LLP

(57) ABSTRACT

A refrigerator with a shelf varied by sliding and pivoting to store thick food items in a storage chamber. The refrigerator includes a main body which has an inner case defining a storage chamber and an outer case defining an external appearance thereof, a first shelf portion arranged at the storage chamber so as to be slidable in front and rear directions, a second shelf portion arranged at the storage chamber so as to be pivotable together with the first shelf portion received in a first shelf receiving portion, and support portions to support the first and second shelf portions, wherein each of the support portions includes a support wall integrally formed with the inner case and an insulation material foamed in a foam space of the support wall.

13 Claims, 13 Drawing Sheets

REFRIGERATOR

CROSS-REFERENCE TO RELATED APPLICATIONS

This application claims the priority benefit of Korean Patent Application No. 10-2011-0073250 filed on Jul. 22, 2011 in the Korean Intellectual Property Office, the disclosure of which is incorporated herein by reference.

BACKGROUND

1. Field

Embodiments relate to a refrigerator with a shelf to slide and pivot when thick food items are stored in a storage chamber in order to secure a storage space.

2. Description of the Related Art

In general, a refrigerator refers to an apparatus which preserves food in a fresh state using cold air generated in a refrigeration cycle. The refrigerator is mounted, at a storage chamber thereof, with shelves on which food is placed and which simultaneously divide the storage chamber into upper and lower chambers.

Among these shelves, there is a variable shelf to enable sliding and pivoting as disclosed in Korean Patent Publication No. 10-2005-0071183, etc. In particular, Korean Patent Publication No. 10-2011-0002589 discloses a structure of the variable shelf which includes a first partition shelf mounted to be pivotable about a rear end thereof and a second partition shelf mounted to be movable relative to the first partition shelf.

Such a variable shelf further includes a shelf frame to support the first and second partition shelves, and the shelf frame is separably mounted at opposite side walls of the storage chamber. That is, the shelf frame may be supported to be placed on upper sides of a pair of support portions which protrude from the opposite side walls of the storage chamber, or be removed from the storage chamber.

Also, the variable shelf adopts a stopper structure to allow first locking portions, having a groove shape, which are formed at sides of the shelf frame to be engaged with second locking portions, having a protrusion shape, which laterally protrude from the first partition shelf.

SUMMARY

Therefore, it is an aspect of an embodiment or embodiments to provide a refrigerator with a variable shelf having a simplified structure by removal of a separate shelf frame.

Additional aspects of an embodiment or embodiments will be set forth in part in the description which follows and, in part, will be apparent from the description, or may be learned by practice.

In accordance with an aspect of an embodiment or embodiments, a refrigerator includes a main body which has an inner case defining a storage chamber and an outer case defining an external appearance thereof, an insulation material being foamed between the inner case and the outer case, a first shelf portion arranged at the storage chamber so as to be slidable in front and rear directions, a second shelf portion including a first shelf receiving portion to receive the first shelf portion, the second shelf portion being arranged at the storage chamber so as to be pivotable together with the first shelf portion received in the first shelf receiving portion, and support portions which protrude into a storage chamber side from opposite sides of the inner case defining the storage chamber so as to support the first and second shelf portions, wherein each of the support portions includes a support wall integrally formed with the inner case and the insulation material foamed in a foam space of the support wall, the support wall having an upper wall, a side wall, and a lower wall so as to form the foam space, a part of each support portion to support the first shelf portion is formed at a higher side than a part of the support portion to support the second shelf portion at a level corresponding to a thickness of the first shelf receiving portion so that a shelf surface of the first shelf portion is positioned on the same plane as a shelf surface of the second shelf portion in a state in which the first shelf portion is withdrawn from the first shelf receiving portion of the second shelf portion, and each support portion is formed, at a rear side thereof, with a shaft receiving portion to receive a pivot shaft of the second shelf portion.

A slanted portion may be formed between the part of each support portion to support the first shelf portion and the part of the support portion to support the second shelf portion.

The refrigerator may further include stoppers provided at upper sides of the support portions, respectively, so as to prevent the first shelf portion from sliding forward, wherein the first shelf portion may be formed with sliding prevention protrusions which laterally protrude to respectively interfere with the stoppers.

Each stopper may be fixedly coupled to the inner case by a fastening member, and the inner case may be coupled, at an inner side surface thereof, with a reinforcement member to reinforce coupling force between the stopper and the inner case.

Each stopper may include a stopper wall portion formed at a lower side of the stopper to interfere with each sliding prevention protrusion, an allowance groove portion formed at an upper side of the stopper wall portion, and a movement restriction portion to define the allowance groove portion and to restrict movement of the first shelf portion.

The stoppers may be integrally formed with the support portions, respectively.

The second shelf portion may further include horizontal flanges to support a rear end of the first shelf portion and vertical flanges which extend upward from the respective horizontal flanges so as to prevent the first shelf portion from sliding rearward.

The second shelf portion may be formed with guide portions which extend in front and rear directions so as to guide the first shelf portion to the first shelf receiving portion.

The first shelf portion, after performing a first operation to move a front end of the first shelf portion up to the stoppers and a second operation to move a rear end of the first shelf portion toward an entrance of the first shelf receiving portion of the second shelf portion, may move to the first shelf receiving portion.

Each support portion may be formed with a protrusion portion which protrudes downward, and the first shelf portion may be formed with a locking hook which interferes with the protrusion portion so as to prevent the first shelf portion from sliding forward.

The locking hook may include an extension portion which extends downward from the first shelf portion and a bent portion which is bent from the extension portion.

In accordance with another aspect of an embodiment or embodiments, a refrigerator includes a main body which has an inner case defining a storage chamber and an outer case defining an external appearance thereof, an insulation material being foamed between the inner case and the outer case, a first shelf portion arranged at the storage chamber so as to be slidable in front and rear directions, a second shelf portion including a first shelf receiving portion to receive the first shelf portion, the second shelf portion being arranged at the storage chamber so as to be pivotable together with the first shelf portion received in the first shelf receiving portion, and support portions which protrude into a storage chamber side from opposite sides of the inner case defining the storage chamber so as to support the first and second shelf portions, wherein each of the support portions includes a support wall integrally formed with the inner case and the insulation material foamed in a foam space of the support wall, the support wall having an upper wall, a side wall, and a lower wall so as to form the foam space, a part of each support portion to support the first shelf portion is formed at a higher side than a part of the support portion to support the second shelf portion at a level corresponding to a thickness of the first shelf receiving portion so that a shelf surface of the first shelf portion is positioned on the same plane as a shelf surface of the second shelf portion in a state in which the first shelf portion is withdrawn from the first shelf receiving portion of the second shelf portion, and the support portions are provided, at upper sides thereof, with stoppers, respectively, so as to prevent the first shelf portion from sliding forward.

The second shelf portion may further include horizontal flanges to support a rear end of the first shelf portion and vertical flanges which extend upward from the respective horizontal flanges so as to prevent the first shelf portion from sliding rearward.

The first shelf portion, after performing a first operation to move a front end of the first shelf portion up to the stoppers and a second operation to move a rear end of the first shelf portion toward an entrance of the first shelf receiving portion of the second shelf portion, may move to the first shelf receiving portion.

The first shelf portion may include a shelf body which is made of a transparent material and on which items are placed, and a front frame coupled to a front side of the shelf body, and the front frame may be formed with sliding prevention protrusions which laterally protrude to respectively interfere with the stoppers.

In accordance with another aspect of an embodiment or embodiments, a refrigerator includes a main body which has an inner case defining a storage chamber and an outer case defining an external appearance thereof, an insulation material being foamed between the inner case and the outer case, a first shelf portion arranged at the storage chamber so as to be slidable in front and rear directions, a second shelf portion including a first shelf receiving portion to receive the first shelf portion, horizontal flanges to support a rear end of the first shelf portion, and vertical flanges which extend upward from the respective horizontal flanges so as to prevent the first shelf portion from sliding rearward, the second shelf portion being arranged at the storage chamber so as to be pivotable together with the first shelf portion received in the first shelf receiving portion, and support portions which protrude into a storage chamber side from opposite sides of the inner case defining the storage chamber so as to support the first and second shelf portions, wherein each of the support portions includes a support wall integrally formed with the inner case and the insulation material foamed in a foam space of the support wall, the support wall having an upper wall, a side wall, and a lower wall so as to form the foam space, a part of each support portion to support the first shelf portion is formed at a higher side than a part of the support portion to support the second shelf portion at a level corresponding to a thickness of the first shelf receiving portion so that a shelf surface of the first shelf portion is positioned on the same plane as a shelf surface of the second shelf portion in a state in which the first shelf portion is withdrawn from the first shelf receiving portion of the second shelf portion, the support portions are respectively provided, at upper sides thereof, with stoppers so as to prevent the first shelf portion from sliding forward, and the first shelf portion, after performing a first operation to move a front end of the first shelf portion up to the stoppers and a second operation to move a rear end of the first shelf portion toward an entrance of the first shelf receiving portion of the second shelf portion, moves to the first shelf receiving portion.

In accordance with a further aspect of an embodiment or embodiments, a refrigerator includes a main body which has an inner case defining a storage chamber and an outer case defining an external appearance thereof, an insulation material being foamed between the inner case and the outer case, a first shelf portion arranged at the storage chamber so as to be slidable in front and rear directions, a second shelf portion including a first shelf receiving portion to receive the first shelf portion, the second shelf portion being arranged at the storage chamber so as to be pivotable together with the first shelf portion received in the first shelf receiving portion, and support portions to support the first and second shelf portions, each of the support portions being formed to protrude from a portion of the inner case, wherein each of the support portions includes a support wall integrally formed with the inner case and the insulation material foamed in a foam space of the support wall, the support wall having an upper wall, a side wall, and a lower wall so as to form the foam space, and each support portion is formed to be stepped so that a shelf surface of the first shelf portion is positioned on the same plane as a shelf surface of the second shelf portion in a state in which the first shelf portion is withdrawn frontward from the first shelf receiving portion.

Each support portion may include a shaft receiving portion formed at a rear end thereof to receive a pivot shaft of the second shelf portion.

BRIEF DESCRIPTION OF THE DRAWINGS

These and/or other aspects of an embodiment or embodiments will become apparent and more readily appreciated from the following description of embodiments, taken in conjunction with the accompanying drawings of which.

DETAILED DESCRIPTION

Figure 1:
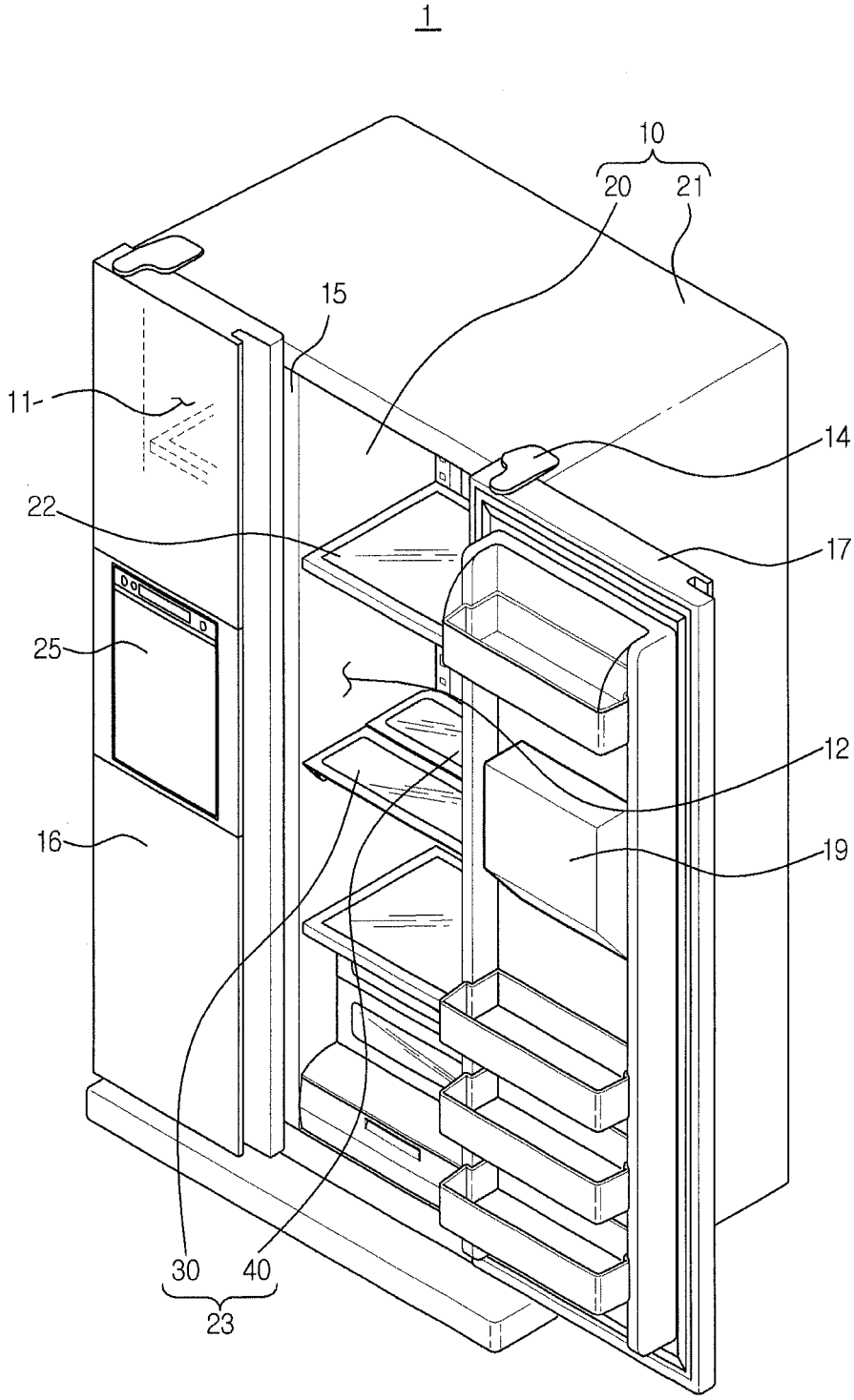
FIG. 1 is a perspective view illustrating a refrigerator according to an embodiment.

Reference will now be made in detail to embodiments, examples of which are illustrated in the accompanying drawings, wherein like reference numerals refer to like elements throughout.

FIG. 1 is a perspective view illustrating a refrigerator according to an embodiment. As shown in FIG. 1, the refrigerator 1, includes a main body 10 defining an external appearance thereof, storage chambers 11 and 12 defined in the main body 10, a cooling unit (not shown) such as a compressor which constitutes a refrigeration cycle to supply the storage chambers 11 and 12 with cold air, and doors 16 and 17 to open and close front faces of the storage chambers 11 and 12, respectively.

The main body 10 is comprised of an inner case 20 defining the storage chambers 11 and 12, and an outer case 21 defining an external appearance thereof. A foam insulation material 24 (see FIG. 2) is foamed between the inner case 20 and the outer case 21 in order to insulate the storage chambers 11 and 12.

The storage chambers 11 and 12 may be divided into a freezing chamber 11 and a refrigerating chamber 12 by a vertical partition wall 15. The freezing and refrigerating chambers 11 and 12 are arranged to be opened at front faces thereof. The doors 16 and 17 are comprised of a freezing chamber door 16 and a refrigerating chamber door 17, respectively, and the freezing and refrigerating chamber doors 16 and 17 may be mounted at the main body 10 by hinges 14 so as to open and close the front faces of the freezing and refrigerating chambers 11 and 12, respectively. Accordingly, the freezing and refrigerating chamber doors 16 and 17 may pivot frontward to open and close the front faces of the freezing and refrigerating chambers 11 and 12, respectively.

The freezing chamber door 16 may be equipped with a dispenser 25 to take out ice cubes or water to the outside without opening the freezing chamber door 16. The refrigerating chamber door 17 may be equipped with a home bar 19 to separately store small food items.

The storage chambers 11 and 12 are provided with shelves 22 and 23 on which various kinds of food items may be placed. In particular, each of the storage chambers 11 and 12 may be provided with a variable shelf 23 to divide the storage chamber 11 or 12 into upper and lower portions. The variable shelf 23 may be maintained in a flat state under ordinary conditions so as to allow the food items to be placed thereon and be varied to secure a storage space when thick food items are stored in the storage chamber 11 or 12.

The variable shelf 23 may include a first shelf portion 30 arranged frontward and a second shelf portion 40 arranged rearward of the first shelf portion 30. The first shelf portion 30 may slide rearward to be disposed beneath the second shelf portion 40 so that the first and second shelf portions 30 and 40 overlap each other. Also, when the first shelf portion 30 is retracted to an inner side of each storage chamber 11 or 12, the second shelf portion 40 may pivot upward about a rear end thereof together with the first shelf portion 30.

Due to such a structure, the first and second shelf portions 30 and 40 pivot to a rear wall side of each storage chamber 11 or 12 so that a space for storage of thick food items may be secured in each of the storage chambers 11 and 12. Hereinafter, structures of the variable shelf and support portions according to an embodiment will be described.

Figure 2:
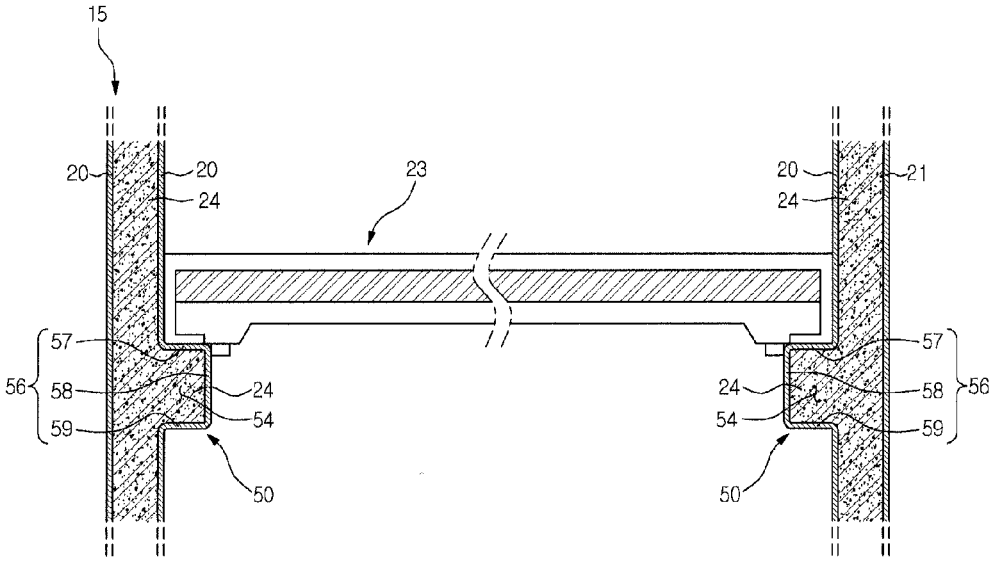
FIG. 2 is a sectional view illustrating a variable shelf and support portions in the refrigerator according to an embodiment.
Figure 3:
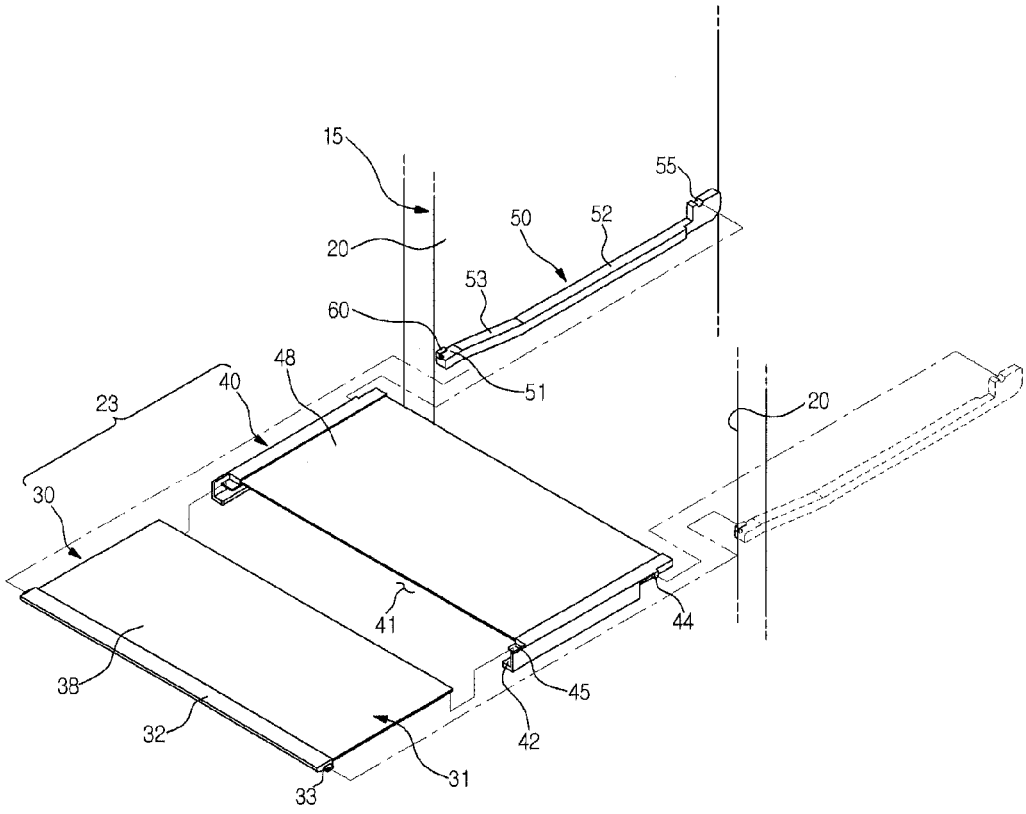
FIG. 3 is an exploded perspective view illustrating the variable shelf in the refrigerator according to an embodiment.
Figure 4:
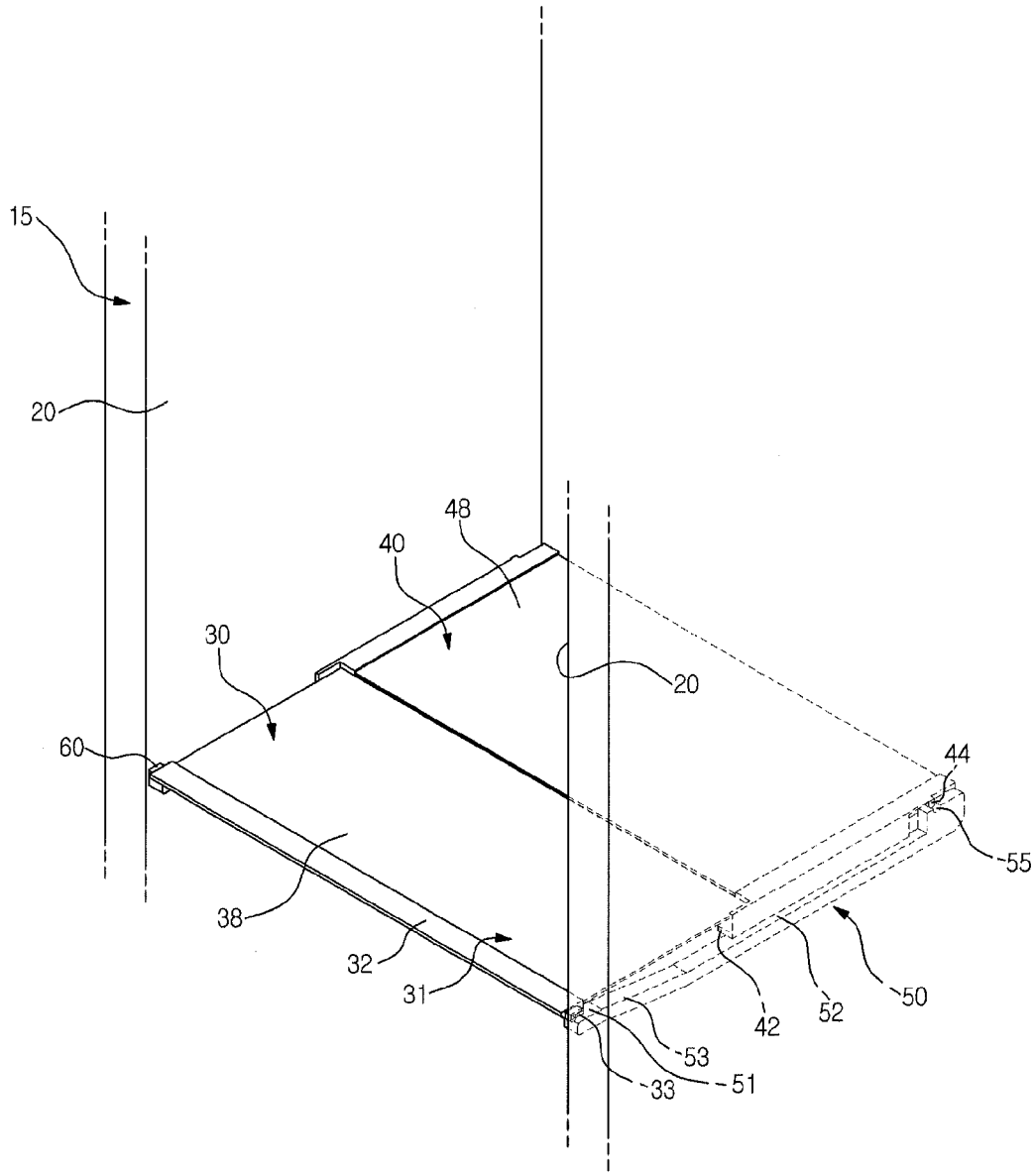
FIG. 4 is a perspective view illustrating a withdrawn state of a first shelf portion in the refrigerator according to an embodiment.
Figure 5:
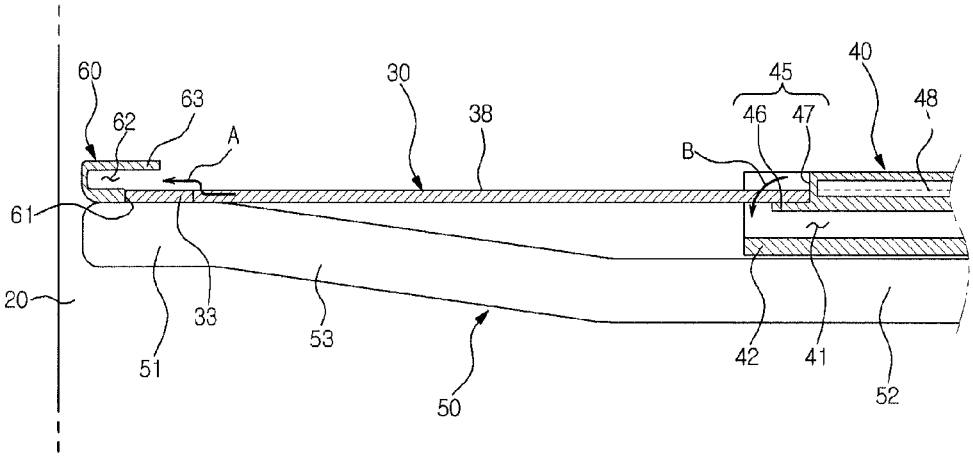
FIG. 5 is a sectional view illustrating the withdrawn state of the first shelf portion in the refrigerator according to an embodiment.
Figure 6:
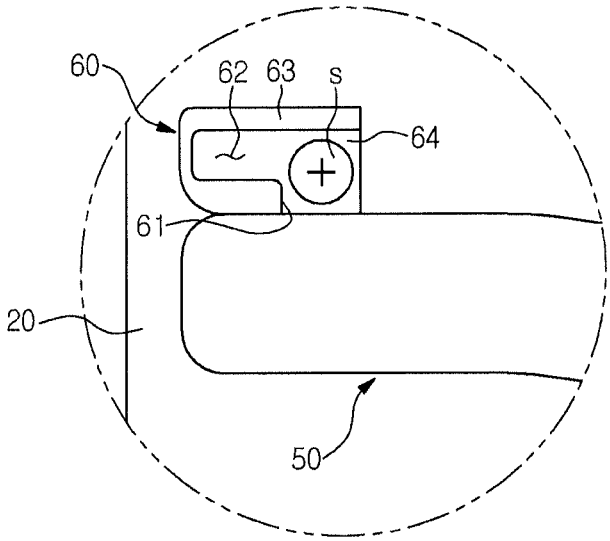
FIG. 6 is an enlarged view illustrating one stopper in the refrigerator according to an embodiment.
Figure 7:
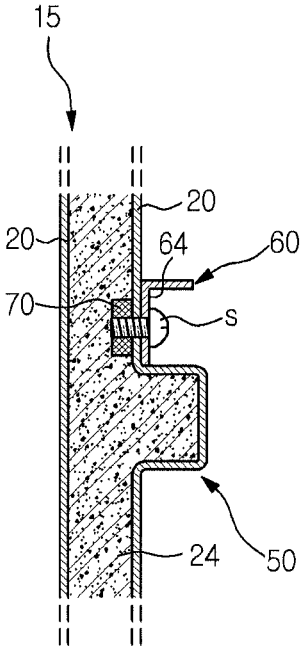
FIG. 7 is a sectional view illustrating a fastening structure of the stopper in the refrigerator according to an embodiment.
Figure 8:
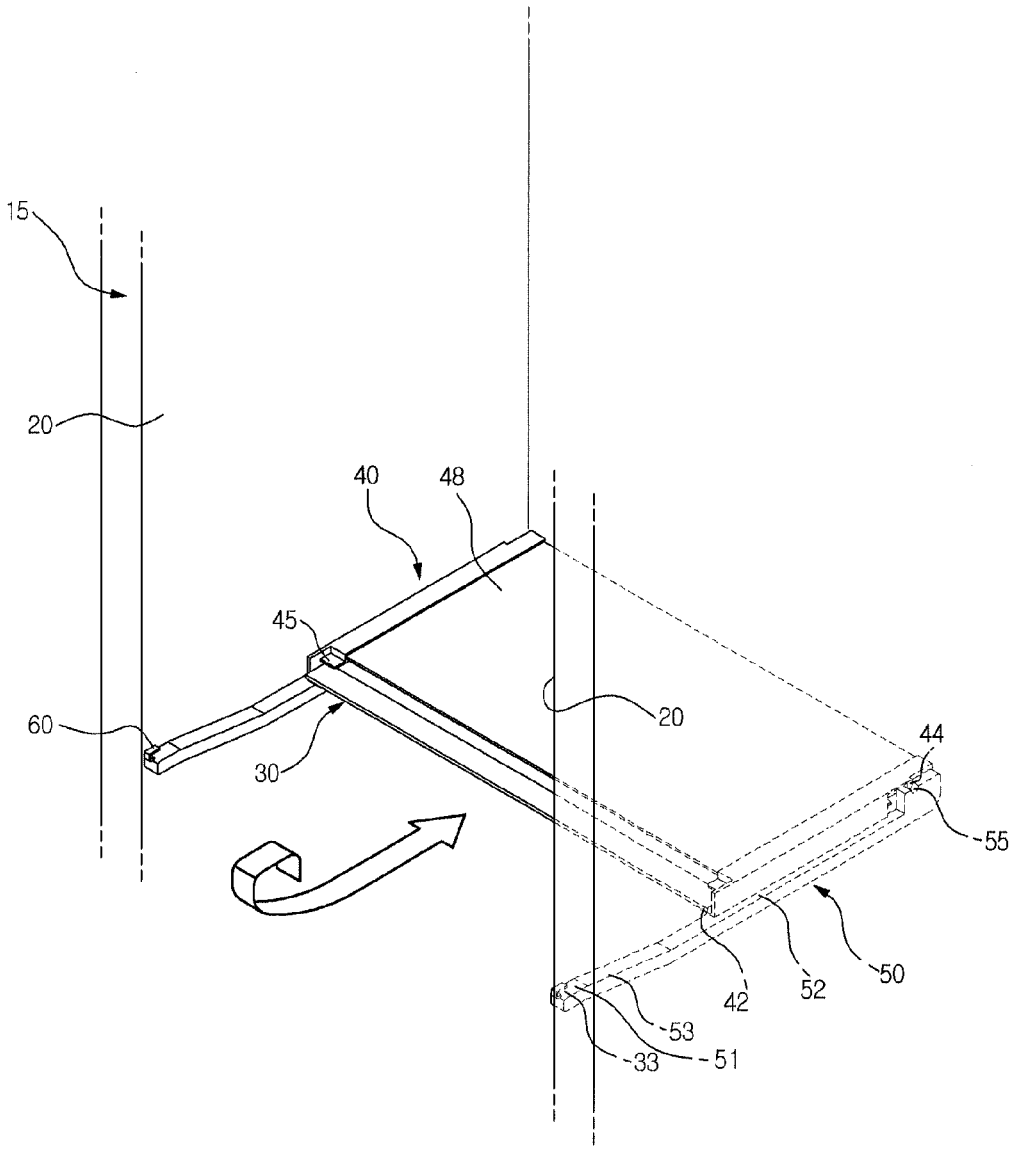
FIG. 8 is a perspective view illustrating a retracted state of the first shelf portion in the refrigerator according to an embodiment.
Figure 9:
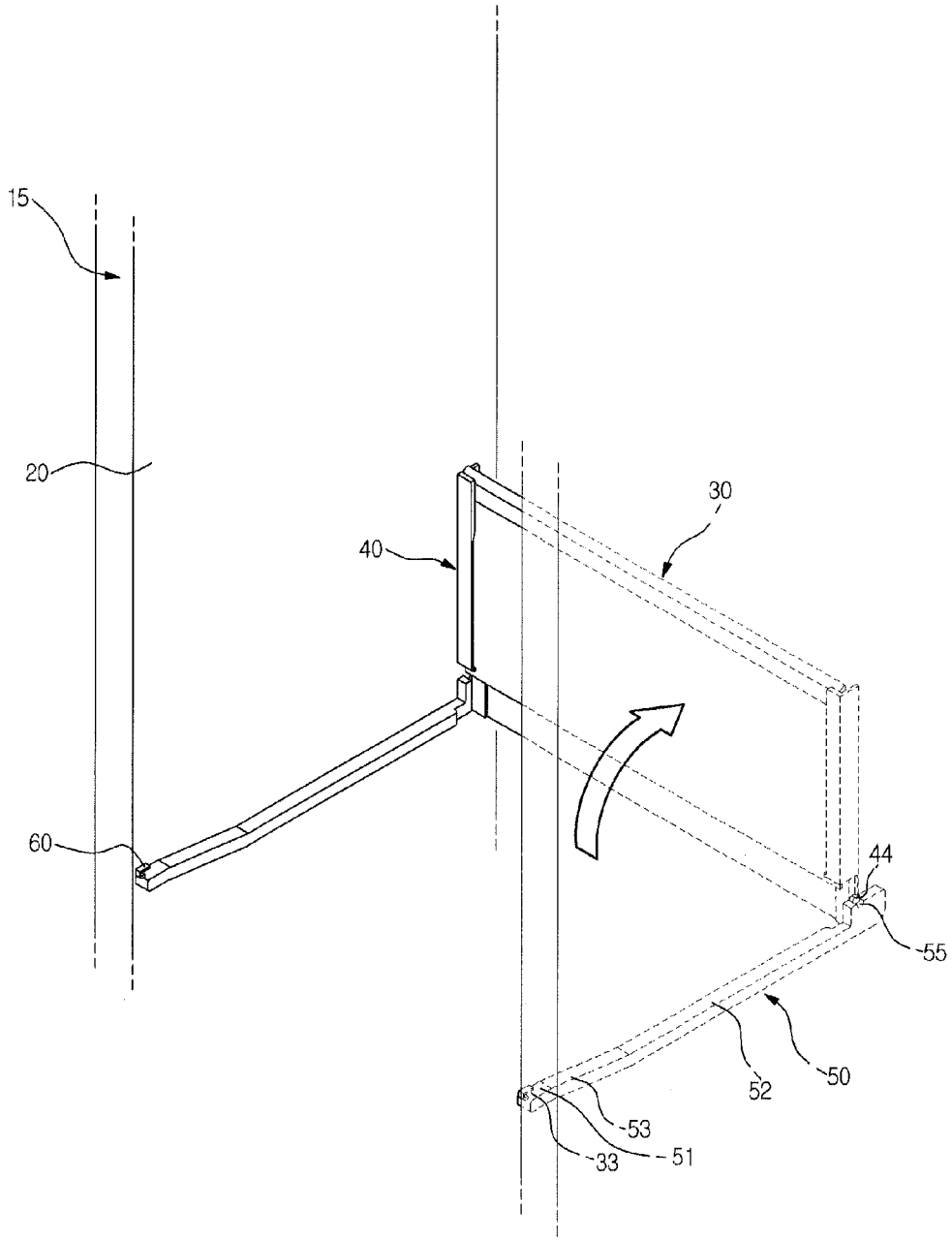
FIG. 9 is a perspective view illustrating a state in which first and second shelf portions pivot upward in the refrigerator according to an embodiment.

FIG. 2 is a sectional view illustrating the variable shelf and the support portions in the refrigerator according to an embodiment. FIG. 3 is an exploded perspective view illustrating the variable shelf in the refrigerator according to an embodiment. FIG. 4 is a perspective view illustrating a withdrawn state of the first shelf portion in the refrigerator according to an embodiment. FIG. 5 is a sectional view illustrating the withdrawn state of the first shelf portion in the refrigerator according to an embodiment. FIG. 6 is an enlarged view illustrating one stopper in the refrigerator according to an embodiment. FIG. 7 is a sectional view illustrating a fastening structure of the stopper in the refrigerator according to an embodiment. FIG. 8 is a perspective view illustrating a retracted state of the first shelf portion in the refrigerator according to an embodiment. FIG. 9 is a perspective view illustrating a state in which the first and second shelf portions pivot upward in the refrigerator according to an embodiment.

Referring to FIG. 3, the variable shelf 23 may include the first shelf portion 30 capable of sliding and the second shelf portion 40 capable of pivoting.

The first shelf portion 30 may include a shelf body 31 having a substantially quadrangular plate shape, for example, so that food items may be placed on the shelf body 31, and a front frame 32 coupled to a front face of the shelf body 31. The shelf body 31 is formed, at an upper face thereof, with a first shelf surface 38 on which items are placed.

The shelf body 31 may be made of a transparent material so as to be able to see through the same. Also, the shelf body 31 may not be coupled, at side faces thereof, with additional frames except for the front frame 32 coupled to the front face of the shelf body 31, as shown in FIG. 3. Accordingly, the first shelf portion 30 may have a simple and aesthetically pleasing external appearance and a space to place food items may be enlarged.

The front frame 32 is formed with sliding prevention protrusions 33 which protrude from opposite sides thereof. Each of the sliding prevention protrusions 33 interferes with the corresponding stopper 60 described below to prevent the first shelf portion 30 from sliding forward.

The first shelf portion 30 is positioned, at front opposite side ends thereof, on the support portions 50, and at rear opposite side ends thereof, on flanges 45 of the second shelf portion 40, thereby being arranged at each storage chamber.

The second shelf portion 40 is arranged in the rear of the first shelf portion 30 while having a flat shape so that food items may be placed on the second shelf portion 40 similar to the first shelf portion 30. A first shelf receiving portion 41 is provided beneath the second shelf portion 40 so as to receive the first shelf portion 30. The first shelf receiving portion 41 is provided, at opposite side thereof, with guide portions 42 protruding in front and rear directions so as to, when the first shelf portion 30 is retracted into the first shelf receiving portion 41, guide the first shelf portion 30.

Also, the flanges 45, on which a rear end of the first shelf portion 30 may be seated, are disposed at front upper sides of the guide portions 42, respectively.

Referring to FIG. 5, each of the flanges 45 is opened at front and upper faces thereof and is formed to have a horizontal flange 46 and a vertical flange 47, and thus may be arranged to support the rear end of the first shelf portion 30. Here, the first shelf portion 30 interferes with the vertical flange 47 to prevent the first shelf portion 30 from sliding rearward.

Accordingly, in order to slide the first shelf portion 30 to the first shelf receiving portion 41, the rear end of the first shelf portion 30 should first be released from the flanges 45. This may be achieved in such a manner that the first shelf portion 30 is slightly lifted at a front end thereof to be withdrawn frontward (A) and then the rear end of the first shelf portion 30 is directed downward of the flanges 45.

The stopper 60 allows the first shelf portion 30 to be prevented from sliding forward. The stopper 60 may include a stopper wall portion 61 which interferes with the corresponding sliding prevention protrusion 33 of the first shelf portion 30 described above, an allowance groove portion 62 formed in a groove shape at an upper side of the stopper wall portion 61, and a movement restriction portion 63 to define the allowance groove portion 62 and to restrict movement of the sliding prevention protrusion 33.

The allowance groove portion 62 serves an allowance space in which the sliding prevention protrusion 33 may move without interference when the first shelf portion 30 is slightly lifted at the front end thereof to be withdrawn frontward, in order to release the rear end of the first shelf portion 30 from the flanges 45.

In this case, the movement restriction portion 63 serves to restrict a movement range of the sliding prevention protrusion 33 to within a predetermined range so that the first shelf portion 30 may easily slide to the first shelf receiving portion 41.

As shown in FIGS. 6 and 7, the stopper 60 may be separately formed to be coupled to the inner case 20.

Furthermore, the stopper 60 may be tightly fixed, at a coupling surface 64 thereof, to the inner case 20 by a fastening member S. The inner case 20 is coupled, at an inner side surface thereof, with a reinforcement member 70 by the fastening member 70, and thus coupling force of the stopper 60 may be reinforced.

The stopper 60 may also be integrally formed with the inner case 20.

Each of the support portions 50 is formed to protrude from a portion of the inner case 20 defining opposite side walls of each storage chamber so as to support the first and second shelf portions 30 and 40. As shown in FIG. 2, the insulation material 24 may be foamed into the inner case 20. That is, the support portion 50 may be integrally formed with the inner case 20.

Each support portion 50 includes a support wall 56 integrally formed with the inner case 20 and the insulation material 24 foamed in a foam space 54 of the support wall 56, and the support wall 56 includes an upper wall 57, a side wall 58, and a lower wall 59 so as to form the foam space 54.

Accordingly, since the variable shelf according to does not require a structure such as a conventional shelf frame, the structure of the variable shelf may be simplified. Consequently, it may be possible to reduce production costs and to provide an aesthetically pleasing appearance. In addition, the space of the storage chamber for storage of food items is consequentially increased.

Referring back to FIG. 3, each support portion 50 is formed to lengthily extend in the front and rear directions, and to be stepped so that the first shelf surface 38 of the first shelf portion 30 and a second shelf surface 48 of the second shelf portion 40 are positioned on the same plane to place food items thereon.

That is, the support portion 50 includes a first support portion 51 to support the first shelf portion 30 and a second support portion 52 to support the second shelf portion 40. The first support portion 51 is arranged at a higher position than the second support portion 52 by a predetermined clearance, and the first and second support portions 51 and 52 are connected by a slanted portion 53.

In accordance with such a configuration, the first shelf portion 30 and the first shelf receiving portion 41 to receive the first shelf portion 30 are formed, and the first shelf surface 38 of the first shelf portion 30 and the second shelf surface 48 of the second shelf portion 40 which is thicker than the first shelf portion 30 may be positioned on the same plane.

The support portion 50 is formed, at a rear side thereof, with a shaft receiving portion 55 on which a pivot shaft 44 of the second shelf portion 40 is pivotably seated.

Hereinafter, operation of the variable shelf in the refrigerator according to an embodiment will be described with reference to FIGS. 4, 5, 8, and 9.

As shown in FIG. 4, the first shelf portion 30 is arranged in a state of being withdrawn frontward from the first shelf receiving portion 41 of the second shelf portion 40 so as to allow the food items to be placed on the first shelf portion 30 under ordinary conditions. In this case, the first shelf portion 30 is supported, at the front end thereof, by the first support portion 51 of the corresponding support portion 50, and at the rear end thereof, by the horizontal flange 46 of the second shelf portion 40.

In this case, since each of the sliding prevention protrusions 33 engages and interferes with the corresponding stopper 60, the first shelf portion 30 may be prevented from sliding forward. Also, since the rear end of the first shelf portion 30 engages and interferes with the vertical flange 47, the first shelf portion 30 may be prevented from sliding rearward.

As shown in FIGS. 5 and 8, the first shelf portion 30 may slide to the first shelf receiving portion 41 of the second shelf portion 40 in such a manner that the first shelf portion 30 is slightly lifted to move frontward (A), thereby moving the corresponding sliding prevention protrusion 33 to the allowance groove portion 62 of the stopper 60, and then the rear end of the first shelf portion 30 moves downward (B) to be released from the flanges 45.

As shown in FIG. 9, the second shelf portion 40 pivots upward about the pivot shaft 44 together with the first shelf portion 30 received in the first shelf receiving portion 41, and thus may secure the space for storage of thick food items. As such, when the first and second shelf portions 30 and 40 pivot to the rear wall side of each storage chamber, the storage space may be secured and an aesthetically pleasing appearance may be provided, as described above, because the opposite side walls of the storage chamber are not provided with the structure such as the conventional shelf frame except for the support portions 50.

Figure 10:
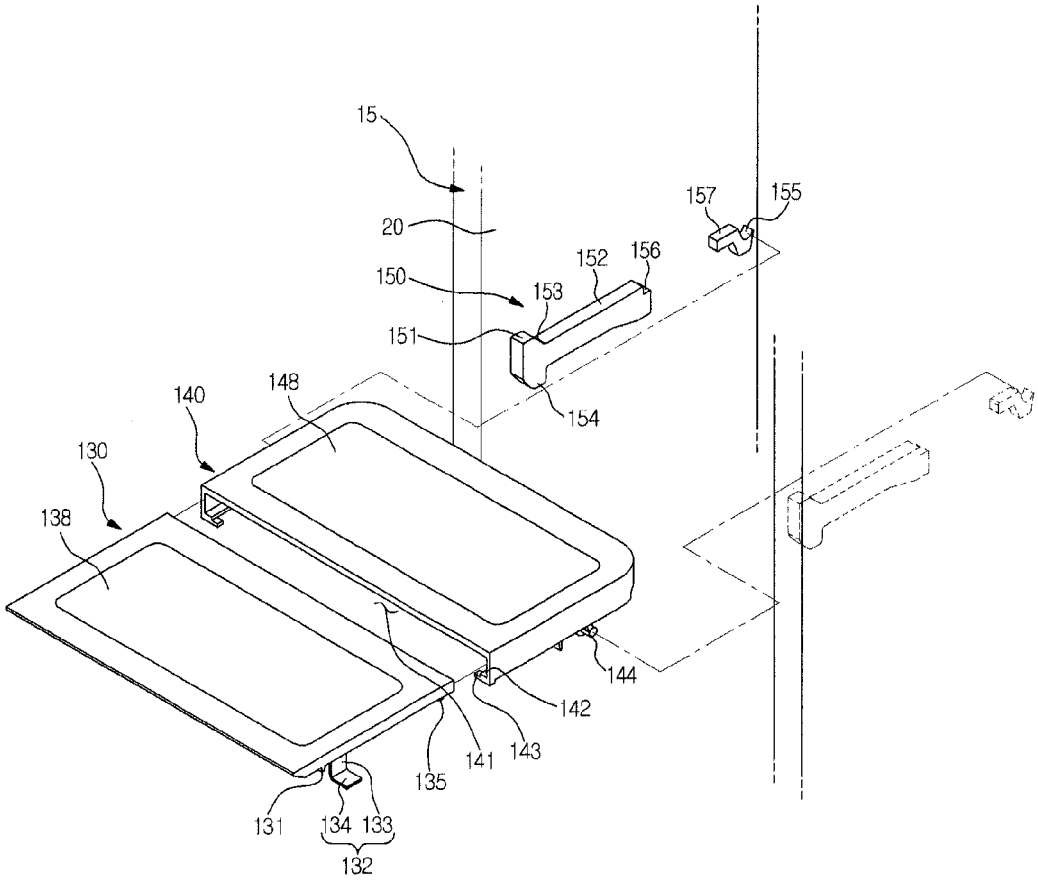
FIG. 10 is an exploded perspective view illustrating a variable shelf in a refrigerator according to an embodiment.
Figure 11:
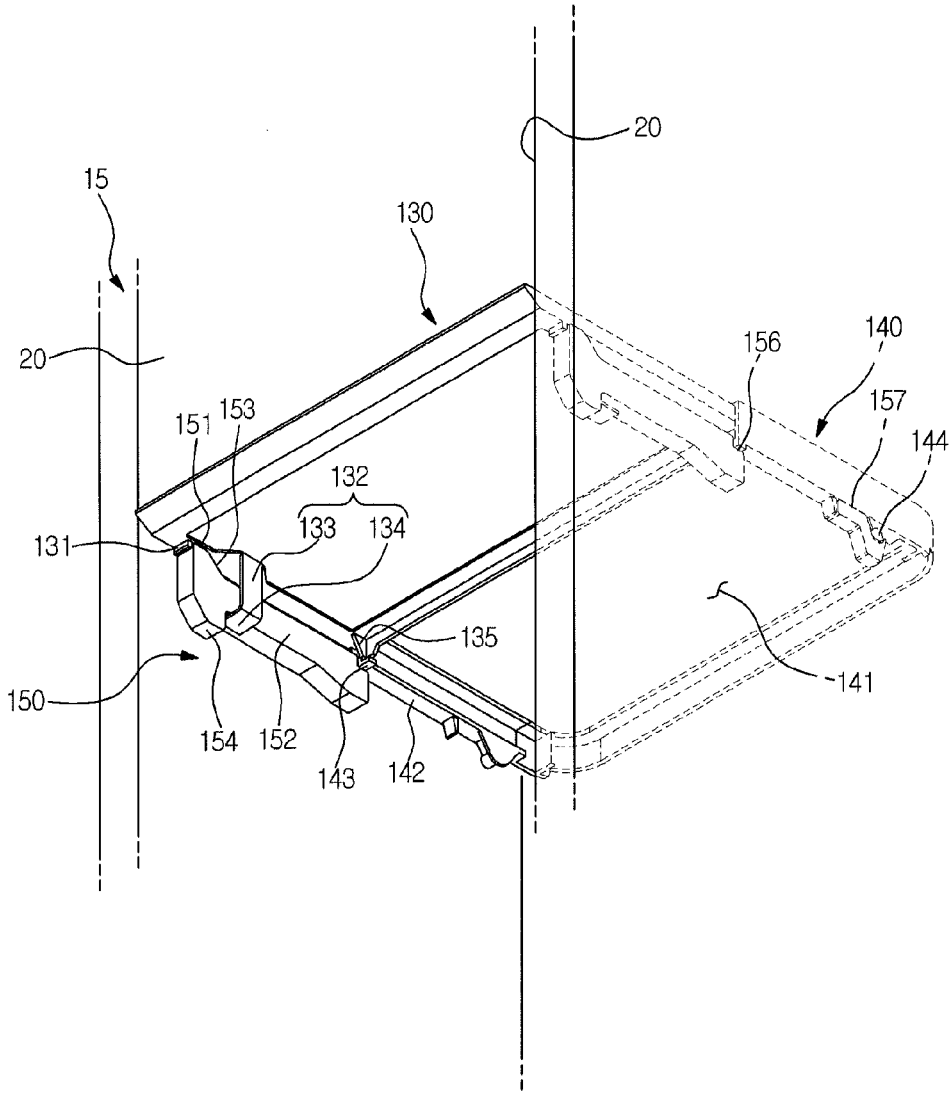
FIG. 11 is a perspective view illustrating a bottom face in a withdrawn state of a first shelf portion in the refrigerator according to an illustrated embodiment.
Figure 12:
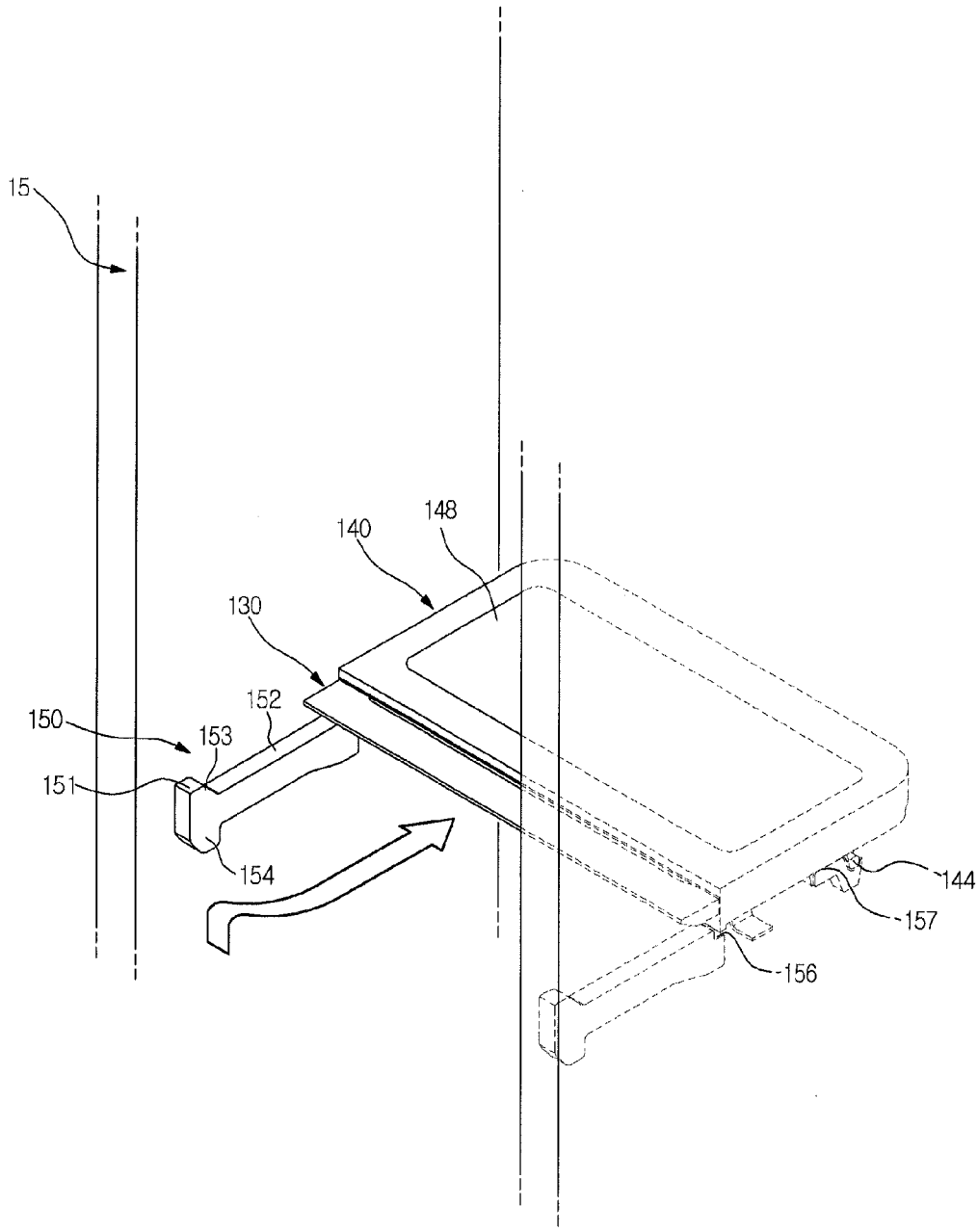
FIG. 12 is a perspective view illustrating a retracted state of the first shelf portion in the refrigerator according to an illustrated embodiment.
Figure 13:
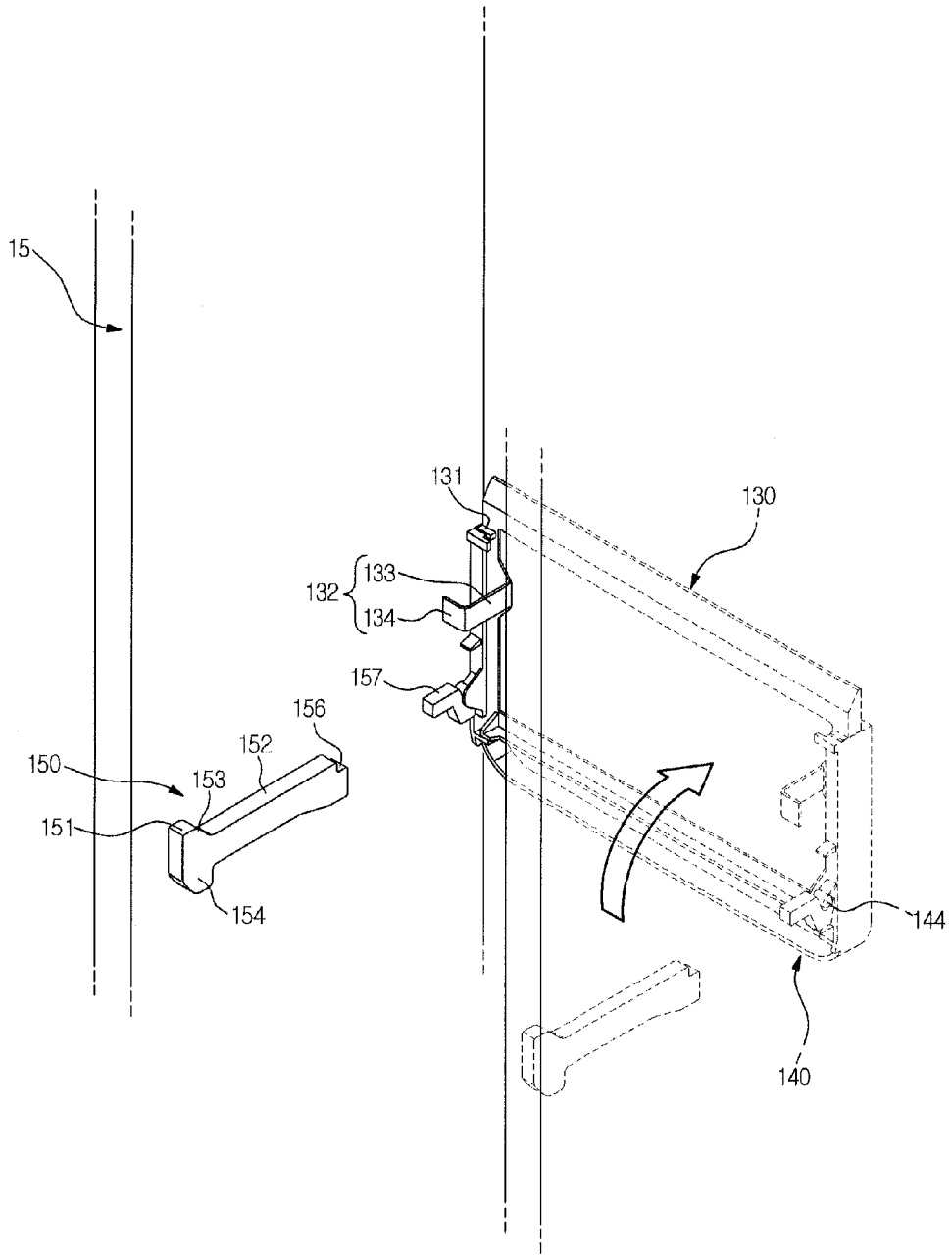
FIG. 13 is a perspective view illustrating a state in which first and second shelf portions pivot upward in the refrigerator according to an illustrated embodiment.

FIG. 10 is an exploded perspective view illustrating a variable shelf in a refrigerator according to an embodiment. FIG. 11 is a perspective view illustrating a bottom face in a withdrawn state of a first shelf portion in the refrigerator according to an illustrated embodiment. FIG. 12 is a perspective view illustrating a retracted state of the first shelf portion in the refrigerator according to an illustrated embodiment. FIG. 13 is a perspective view illustrating a state in which first and second shelf portions pivot upward in the refrigerator according to an illustrated embodiment.

Hereinafter, the refrigerator according to an embodiment will be described, but like reference numerals will refer to like elements and no description will be given thereof with respect to the same configuration as an embodiment.

Referring to FIGS. 10 to 13, the first shelf portion 130 is arranged at each storage chamber so as to be slidable in front and rear directions.

The second shelf portion 140 is arranged rearward of the first shelf portion 130. The second shelf portion 140 includes a first shelf receiving portion 141 to receive the first shelf portion 130 and a pivot shaft 144 so as to be pivotable together with the first shelf portion 130. The first shelf receiving portion 141 is formed, at opposite sides thereof, with guide portions 142 which extend in front and rear directions so as to guide the first shelf portion 130 to the first shelf receiving portion 141.

The first and second shelf portions 130 and 140 are positioned, at opposite side ends thereof, on support portions 150 to be disposed at each storage chamber, and each of the support portions 150 is formed to protrude from a portion of the inner case 20.

The support portion 150 is formed to extend in front and rear directions, and to be stepped so that first and second shelf surfaces 138 and 148 of the respective first and second shelf portions 130 and 140 having a different thickness from each other are positioned on the same plane to support the first and second shelf portions 130 and 140.

That is, the support portion 150 includes a first support portion 151 to support the first shelf portion 130 and a second support portion 152 to support the second shelf portion 140. The first support portion 151 may be arranged at a slightly higher side than the second support portion 152, and the first and second support portions 151 and 152 may be connected by a slanted portion 153.

Here, the pivot shaft 144 of the second shelf portion 140 may be seated on a shaft receiving portion 155, and the second shelf portion 140 may pivot about the pivot shaft 144 in upward and downward directions.

The second support portion 152 may be provided to be disconnected by a predetermined clearance, as shown in the drawing. That is, the second support portion 152 is formed to be separated between a front end support portion 156 and a rear end support portion 157. This is because the second support portion 152 may be sufficiently supported only by the front and rear end support portions 156 and 157.

In other words, the second shelf portion 140 may be arranged at each storage chamber in such a manner that the second shelf portion 140 is supported, at a front end thereof, by the front end support portion 156, and at a rear end thereof, by the rear end support portion 157.

Each support portion 150 may be formed, at a front side thereof, with a protrusion portion 154 which protrudes downward. The protrusion portion 154 is provided to interfere with corresponding one of locking hooks 132 of the first shelf portion 130 described below, and this will be described in detail.

The first shelf portion 130 may be formed, at a front end thereof, with locking protrusions 131 which protrude downward to prevent the first shelf portion 130 from sliding rearward and locking hooks 132 to prevent the first shelf portion 130 from sliding forward.

Each of the locking protrusions 131 may be provided so as to engage and interfere with a substantially front face of the corresponding first support portion 151. Accordingly, in order to slide the first shelf portion 130 rearward, the first shelf portion 130 is slightly lifted, at the front end thereof, to avoid interference between the locking protrusion 131 and the first support portion 151.

Each of the locking hooks 132 may include an extension portion 133 which extends downward and a bent portion 134 which is bent from the extension portion 133.

The bent portion 134 of the locking hook 132 interferes with the protrusion portion 154 described above, and thus may prevent the first shelf portion 130 from sliding forward. Furthermore, the bent portion 134 of the locking hook 132 interferes with a lower face of the corresponding support portion 150, and thus may prevent the first shelf portion 130 from oscillating upward.

On the other hand, the first shelf portion 130 is formed, at a rear lower portion thereof, with a height adjusting protrusion 135 extending downward so that the first shelf surface 138 of the first shelf portion 130 may be positioned on the same plane as the second shelf surface 148 of the second shelf portion 140. The height adjusting protrusion 135 may be supported by height adjusting protrusion support portions 143 formed at the second shelf portion 140. Each of the height adjusting protrusion support portions 143 may be formed so as to extend to one side from the corresponding guide portion 142 of the second shelf portion 140.

Hereinafter, operation of the variable shelf in the refrigerator according to an embodiment will be described with reference to FIGS. 11 to 13.

As shown in FIG. 11, the first shelf portion 130 is arranged to be withdrawn frontward from the first shelf receiving portion 141 of the second shelf portion 140 so that the first shelf surface 138 and the second shelf surface 148 of the second shelf portion 140 are positioned on the same plane so as to allow the food items to be placed on the first shelf portion 130 under ordinary conditions.

In this case, the first shelf portion 130 is supported, at the front end thereof, by the first support portion 151 of the corresponding support portion 150, and the height adjusting protrusion 135 is supported by the height adjusting protrusion support portions 143.

Also, each locking protrusion 131 of the first shelf portion 130 engages and interferes with the corresponding first support portion 151 and thus may prevent the first shelf portion 130 from sliding rearward, whereas each locking hook 132 of the first shelf portion 130 engages and interferes with the corresponding protrusion portion 154 and thus may prevent the first shelf portion 130 from sliding forward.

As shown in FIG. 12, after the first shelf portion 130 is slightly lifted at the front end thereof so that the locking protrusion 131 does not interfere with the first support portion 151, the first shelf portion 130 is pushed so as to retract the first shelf portion 130 into the first shelf receiving portion 141.

As shown in FIG. 13, the second shelf portion 140 pivots upward about the pivot shaft 144 together with the first shelf portion 130 received in the first shelf receiving portion 141, and thus may secure the space for storage of thick food items.

As is apparent from the above description, the variable shelf capable of sliding and pivoting may be embodied without the conventional shelf frame structure.

Accordingly, cost reduction may be achieved when applying the variable shelf to the refrigerator.

Also, since the conventional shelf frame is removed at the opposite sides of the storage chamber, the storage space may be enlarged.

In addition, since the inner structure of the storage chamber is simplified, an aesthetically pleasing appearance may be provided.

Although some embodiments have been shown and described, it would be appreciated by those skilled in the art that changes may be made in embodiments without departing from the principles and spirit, the scope of which is defined in the claims and their equivalents.

What is claimed is:

1. A refrigerator comprising:

a main body which has an inner case defining a storage chamber and an outer case defining an external appearance thereof, an insulation material being foamed between the inner case and the outer case;

a first shelf portion arranged at the storage chamber so as to be slidable in front and rear directions;

a second shelf portion including a first shelf receiving portion to receive the first shelf portion, the second shelf portion being arranged at the storage chamber so as to be pivotable together with the first shelf portion received in the first shelf receiving portion;

support portions which protrude into a storage chamber side from opposite sides of the inner case defining the storage chamber so as to support the first and second shelf portions; and stoppers provided at upper sides of the support portions, respectively, so as to prevent the first shelf portion from sliding forward, wherein:

each of the support portions includes a support wall integrally formed with the inner case and the insulation material foamed in a foam space of the support wall, the support wall having an upper wall, a side wall, and a lower wall so as to form the foam space;

a part of each support portion to support the first shelf portion is formed at a higher side than a part of the support portion to support the second shelf portion at a level corresponding to a thickness of the first shelf receiving portion so that a shelf surface of the first shelf portion is positioned on the same plane as a shelf surface of the second shelf portion in a state in which the first shelf portion is withdrawn from the first shelf receiving portion of the second shelf portion;

each support portion is formed, at a rear side thereof, with a shaft receiving portion to receive a pivot shaft of the second shelf portion;

the first shelf portion is formed with sliding prevention protrusions which laterally protrude to respectively interfere with the stoppers, wherein each stopper comprises a stopper wall portion formed at a lower side of the stopper to interfere with each sliding prevention protrusion, an allowance groove portion formed at an upper side of the stopper wall portion and recessed frontward so as to serve the allowance space in which the sliding prevention protrusion enable to move without interference when the first shelf portion is slightly lifted at the front end thereof to be withdrawn frontward, and a movement restriction portion formed above the allowance groove portion to define the allowance groove portion and to restrict movement of the first shelf portion.

2. The refrigerator according to claim 1, wherein a slanted portion is formed between the part of each support portion to support the first shelf portion and the part of the support portion to support the second shelf portion.

3. The refrigerator according to claim 1, wherein the stoppers are integrally formed with the support portions, respectively.

4. The refrigerator according to claim 1, wherein the second shelf portion is formed with guide portions which extend in front and rear directions so as to guide the first shelf portion to the first shelf receiving portion.

5. The refrigerator according to claim 1, wherein the first shelf portion, after performing a first operation to move a front end of the first shelf portion up to the stoppers and a second operation to move a rear end of the first shelf portion toward an entrance of the first shelf receiving portion of the second shelf portion, moves to the first shelf receiving portion.

6. A refrigerator comprising:

a main body which has an inner case defining a storage chamber and an outer case defining an external appearance thereof, an insulation material being foamed between the inner case and the outer case;

a first shelf portion arranged at the storage chamber so as to be slidable in front and rear directions;

a second shelf portion including a first shelf receiving portion to receive the first shelf portion, the second shelf portion being arranged at the storage chamber so as to be pivotable together with the first shelf portion received in the first shelf receiving portion;

support portions which protrude into a storage chamber side from opposite sides of the inner case defining the storage chamber so as to support the first and second shelf portions; and stoppers provided at upper sides of the support portions, respectively, so as to prevent the first shelf portion from sliding forward, wherein:

each of the support portions includes a support wall integrally formed with the inner case and the insulation material foamed in a foam space of the support wall, the support wall having an upper wall, a side wall, and a lower wall so as to form the foam space;

a part of each support portion to support the first shelf portion is formed at a higher side than a part of the support portion to support the second shelf portion at a level corresponding to a thickness of the first shelf receiving portion so that a shelf surface of the first shelf portion is positioned on the same plane as a shelf surface of the second shelf portion in a state in which the first shelf portion is withdrawn from the first shelf receiving portion of the second shelf portion;

each stopper is fixedly coupled to the inner case by a fastening member; and the inner case is coupled, at an inner side surface thereof, with a reinforcement member to reinforce the coupling force between the stopper and the inner case.

7. A refrigerator comprising:

a main body which has an inner case defining a storage chamber and an outer case defining an external appearance thereof, an insulation material being foamed between the inner case and the outer case;

a first shelf portion arranged at the storage chamber so as to be slidable in front and rear directions;

a second shelf portion including a first shelf receiving portion to receive the first shelf portion, the second shelf portion being arranged at the storage chamber so as to be pivotable together with the first shelf portion received in the first shelf receiving portion; and support portions which protrude into a storage chamber side from opposite sides of the inner case defining the storage chamber so as to support the first and second shelf portions, wherein:

each of the support portions includes a support wall integrally formed with the inner case and the insulation material foamed in a foam space of the support wall, the support wall having an upper wall, a side wall, and a lower wall so as to form the foam space;

a part of each support portion to support the first shelf portion is formed at a higher side than a part of the support portion to support the second shelf portion at a level corresponding to a thickness of the first shelf receiving portion so that a shelf surface of the first shelf portion is positioned on the same plane as a shelf surface of the second shelf portion in a state in which the first shelf portion is withdrawn from the first shelf receiving portion of the second shelf portion; and each support portion is formed, at a rear side thereof, with a shaft receiving portion to receive a pivot shaft of the second shelf portion, wherein the second shelf portion further comprises horizontal flanges to support a rear end of the first shelf portion and vertical flanges which extend upward from the respective horizontal flanges so as to prevent the first shelf portion from sliding rearward.

8. A refrigerator comprising:

a main body which has an inner case defining a storage chamber and an outer case defining an external appearance thereof, an insulation material being foamed between the inner case and the outer case;

a first shelf portion arranged at the storage chamber so as to be slidable in front and rear directions;

a second shelf portion including a first shelf receiving portion to receive the first shelf portion, the second shelf portion being arranged at the storage chamber so as to be pivotable together with the first shelf portion received in the first shelf receiving portion; and support portions which protrude into a storage chamber side from opposite sides of the inner case defining the storage chamber so as to support the first and second shelf portions, wherein:

each of the support portions includes a support wall integrally formed with the inner case and the insulation material foamed in a foam space of the support wall, the support wall having an upper wall, a side wall, and a lower wall so as to form the foam space;

a part of each support portion to support the first shelf portion is formed at a higher side than a part of the support portion to support the second shelf portion at a level corresponding to a thickness of the first shelf receiving portion so that a shelf surface of the first shelf portion is positioned on the same plane as a shelf surface of the second shelf portion in a state in which the first shelf portion is withdrawn from the first shelf receiving portion of the second shelf portion; and each support portion is formed, at a rear side thereof, with a shaft receiving portion to receive a pivot shaft of the second shelf portion, wherein:

each support portion is formed with a protrusion portion which protrudes downward; and the first shelf portion is formed with a locking hook which interferes with the protrusion portion so as to prevent the first shelf portion from sliding forward.

9. The refrigerator according to claim 8, wherein the locking hook comprises an extension portion which extends downward from the first shelf portion and a bent portion which is bent from the extension portion.

10. A refrigerator comprising:

a main body which has an inner case defining a storage chamber and an outer case defining an external appearance thereof, an insulation material being foamed between the inner case and the outer case;

a first shelf portion arranged at the storage chamber so as to be slidable in front and rear directions;

a second shelf portion including a first shelf receiving portion to receive the first shelf portion, the second shelf portion being arranged at the storage chamber so as to be pivotable together with the first shelf portion received in the first shelf receiving portion; and support portions which protrude into a storage chamber side from opposite sides of the inner case defining the storage chamber so as to support the first and second shelf portions, wherein:

each of the support portions includes a support wall integrally formed with the inner case and the insulation material foamed in a foam space of the support wall, the support wall having an upper wall, a side wall, and a lower wall so as to form the foam space;

a part of each support portion to support the first shelf portion is formed at a higher side than a part of the support portion to support the second shelf portion at a level corresponding to a thickness of the first shelf receiving portion so that a shelf surface of the first shelf portion is positioned on the same plane as a shelf surface of the second shelf portion in a state in which the first shelf portion is withdrawn from the first shelf receiving portion of the second shelf portion;

the support portions are provided, at upper sides thereof, with stoppers, respectively, so as to prevent the first shelf portion from sliding forward; and the second shelf portion further comprises horizontal flanges to support a rear end of the first shelf portion and vertical flanges which extend upward from the respective horizontal flanges so as to prevent the first shelf portion from sliding rearward.

11. The refrigerator according to claim 10, wherein the first shelf portion, after performing a first operation to move a front end of the first shelf portion up to the stoppers and a second operation to move a rear end of the first shelf portion toward an entrance of the first shelf receiving portion of the second shelf portion, moves to the first shelf receiving portion.

12. The refrigerator according to claim 10, wherein:

the first shelf portion comprises a shelf body which is made of a transparent material and on which items are placed, and a front frame coupled to a front side of the shelf body; and the front frame is formed with sliding prevention protrusions which laterally protrude to respectively interfere with the stoppers.

13. A refrigerator comprising:

a main body which has an inner case defining a storage chamber and an outer case defining an external appearance thereof, an insulation material being foamed between the inner case and the outer case;

a first shelf portion arranged at the storage chamber so as to be slidable in front and rear directions;

a second shelf portion including a first shelf receiving portion to receive the first shelf portion, horizontal flanges to support a rear end of the first shelf portion, and vertical flanges which extend upward from the respective horizontal flanges so as to prevent the first shelf portion from sliding rearward, the second shelf portion being arranged at the storage chamber so as to be pivotable together with the first shelf portion received in the first shelf receiving portion; and support portions which protrude into a storage chamber side from opposite sides of the inner case defining the storage chamber so as to support the first and second shelf portions, wherein:

each of the support portions includes a support wall integrally formed with the inner case and the insulation material foamed in a foam space of the support wall, the support wall having an upper wall, a side wall, and a lower wall so as to form the foam space;

a part of each support portion to support the first shelf portion is formed at a higher side than a part of the support portion to support the second shelf portion at a level corresponding to a thickness of the first shelf receiving portion so that a shelf surface of the first shelf portion is positioned on the same plane as a shelf surface of the second shelf portion in a state in which the first shelf portion is withdrawn from the first shelf receiving portion of the second shelf portion;

the support portions are respectively provided, at upper sides thereof, with stoppers so as to prevent the first shelf portion from sliding forward; and the first shelf portion, after performing a first operation to move a front end of the first shelf portion up to the stoppers and a second operation to move a rear end of the first shelf portion toward an entrance of the first shelf receiving portion of the second shelf portion, moves to the first shelf receiving portion.

* * * * *